US005364727A

United States Patent [19]

Nguyen

[11] Patent Number: 5,364,727

[45] Date of Patent: Nov. 15, 1994

[54] POSITIVE-CHARGING ORGANIC PHOTOCONDUCTOR FOR LIQUID ELECTROPHOTOGRAPHY

[75] Inventor: Khe C. Nguyen, Milpitas, Calif.

[73] Assignee: Hewlett-Packard Company, Palo Alto, Calif.

[21] Appl. No.: 81,047

[22] Filed: Jun. 21, 1993

[51] Int. Cl.[5] ..... G03G 13/10

[52] U.S. Cl. ..... 430/119; 430/59; 430/83

[58] Field of Search ..... 430/59, 83, 119

[56] References Cited

U.S. PATENT DOCUMENTS

| | | | |
|---|---|---|---|
| 4,559,287 | 12/1985 | McAneney et al. | 430/59 |
| 4,755,443 | 7/1988 | Suzuki et al. | 430/83 X |
| 4,891,288 | 1/1990 | Fujimaki et al. | 430/58 |
| 4,923,775 | 5/1990 | Schank | 430/59 |
| 5,069,993 | 12/1991 | Robinette et al. | 430/58 |
| 5,087,540 | 2/1992 | Murakami et al. | 430/58 |
| 5,112,711 | 5/1992 | Nguyen et al. | 430/83 X |

FOREIGN PATENT DOCUMENTS

| | | | |
|---|---|---|---|
| 0385440 | 9/1990 | European Pat. Off. | 430/59 |
| 123542 | 7/1983 | Japan | 430/59 |
| 182655 | 6/1992 | Japan | 430/59 |

*Primary Examiner*—Roland Martin

[57] ABSTRACT

An electrophotographic method for liquid toner development using an organic, positive-charging photoconductor (<+>OPC) is disclosed. The (+) OPC has a conductive substrate, and a polymeric binder with polar and non-polar functional moieties, the binder being a layer on the substrate greater than or equal to about 1 micron thick. Also, the (+) OPC has a phthalocyanine pigment component, and an arylamine sensitizer component selected from the group of:

$N—Ar(R_i)_n$, i=1,2,3 n=0,5 where Ar=phenyl, naphthyl, biphenyl or ter-phenyl groups, and $—(O—C\text{-phenyl-}N\text{-phenyl})_{[n]x}$,

[n]x =1–10, both the phthalocyanine component and the arylamine sensitizer component being uniformly distributed throughout the binder component.

8 Claims, No Drawings

POSITIVE-CHARGING ORGANIC PHOTOCONDUCTOR FOR LIQUID ELECTROPHOTOGRAPHY

BACKGROUND OF THE INVENTION

1. Technical Field

This invention relates generally to photoconductor electrophotography. I have invented a single-layer, positive-charging, organic photoconductor material with low pigment loading for liquid toner electrophotography.

2. Background Art

In electrophotography, a latent image is created on the surface of an insulating, photoconducting material by selectively exposing areas of the surface to light. A difference in electrostatic charge density is created between the areas on the surface exposed and unexposed to light. The latent electrostatic image is developed into a visible image by electrostatic toners containing pigment components and thermoplastic components. The toners are selectively attracted to the photoconductor surface either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same polarity, but different levels of charge.

A sheet of paper or intermediate transfer medium is given an electrostatic charge opposite that of the toner and passed close to the photoconductor surface, pulling the toner from the photoconductor surface onto the paper or intermediate medium still in the pattern of the image developed from the photoconductor surface. A set of fuser rollers melts and fixes the toner in the paper, subsequent to direct transfer, or indirect transfer when using an intermediate transfer medium, producing the printed image.

There is a demand in the laser printer industry for multi-colored images. Responding to this demand, designers have turned to liquid toners, with pigment components and thermoplastic components dispersed in a liquid carrier medium, usually special hydrocarbon liquids. With liquid toners, it has been discovered, the basic printing colors—yellow, magenta, cyan and black, may be applied sequentially to a photoconductor surface, and from there to a sheet of paper or intermediate medium to produce a multi-colored image.

The important photoconductor surface, therefore, has been the subject of much research and development in the electrophotography art. A large number of photoconductor materials have been disclosed as being suitable for the electrophotographic photoconductor surface. For example, inorganic compounds such as amorphous silicon (Si), arsenic selenide ($AS_2Se_3$), cadmium sulfide (CdS), selenium (Se), titanium oxide ($TiO_2$) and zinc oxide (ZnO) function as photoconductors. However, these inorganic materials do not satisfy modern requirements in the electro-photography art of low production costs, high-speed response to laser diode or other light-emitting-diode (LED) and safety from non-toxicity.

Therefore, recent progress in the electrophotography art with the photoconductor surface has been made with organic materials as organic photoconductors (OPC). Typically, the OPC's in the current market are of the negative-charging type with a thin charge generation material layer beneath a thicker charge transport material layer deposited on top of the charge generation layer. The negative-charging OPC's perform well for xerographic copiers and printers in the following applications:

a. Low end (4–10 copies per minute) and high end (more than 50 copies per minute) xerographic systems using dry powder developers of one or two colors, or using liquid developers for black and white copies only; and, b. High image quality (above 1800 DPI) color proofing, lithographic plate printing and master xeroprinting systems with life expectancies of less than 100 cycles.

However, prior art negative-charging OPC's also have several drawbacks, namely:

1. Large amounts of ozone are generated in the negative corona-charging process, creating environmental concerns. This problem has been addressed by installing ozone absorbers like activated carbon filters, and by using contact negative-charging instead of corona- charging. These ozone remediation approaches, however, have drawbacks of their own and are not attractive commercial solutions.
2. Negative corona-charging generally results in less charge pattern uniformity compared to positive corona-charging. Lower charge pattern uniformity in turn results in more noise and less definition in the final image.
3. In liquid toner processes, designers have been able to develop more charge stability in positively charged toners than in negatively charged toners. Therefore, positive-charging OPC's are preferred for a discharged area developed image as in laser printers.

From the prior art it is known that most of the phthalocyanines (Pc) may serve as photoconductors. Also, it is known to disperse phthalocyanines as a charge generation material in a polymeric binder matrix which serves as a charge transport material. However, these approaches, for single-layer photoconductors with low Pc loadings, for example 1–30 wt. %, have been used only in low end (less than 10 copies per minute) and high end (more than 50 copies per minute) dry powder developers, and not in liquid toner environments.

Specific morphologies of phthalocyanine pigment powder have been known to exhibit excellent photoconductivity. These phthalocyanine pigments have been used as a mixture in polymeric binder matrices in electrophotographic photoconductors, deposited on a conductive substrate. In these phthalocyanine/binder photoconductors, the photogeneration of charge and the charge transport occur in the particles of the phthalocyanine pigment while the binder is inert. Therefore, the photoconductor may be made of a single layer of phthalocyanine/binder. These single-layer photoconductors are known to be very good positive-charging OPC's due to the hole (positive charge) transportability of the phthalocyanine pigment.

In these single-layer photoconductors, then, there is no need to add charge transport molecules, nor to have a separate charge transport layer. The phthalocyanine pigment content may be in the range of about 10–30 wt. %, high enough to perform both charge generation and charge transport functions, with the binder content being in the range of about 90–70 wt. %. The single photoconductor layer is usually more than about 3 microns (um) thick in order to achieve the required charge acceptance and resulting image contrast. In any event, it is more than 1 micron thick which is the maximum thickness for charge generation layers in multi-layer photoconductors.

Also, it is known to use phthalocyanine pigment as a charge generation component in a multi-layer photoconductor. Today, the commercially available OPC for digital electrophotography, wherein the writing head is LED array or laser diode, uses such a multi-layer photoconductor. The charge generation layer containing the phthalocyanine pigment is less than 1 micron (um) thick. A charge transport layer about 20–30 microns (um) thick and containing transport molecules other than the phthalocyanine pigment, is overcoated on top of the charge generation layer.

These types of multi-layer OPC's, however, are only used as negative-charging ones, so they have all the drawbacks of negative-charging OPC's discussed above. So, there remains a strong incentive for the development of a phthalocyanine pigment type positive-charging OPC.

It is known to use a positive-charging OPC for liquid toner electrophotography. This generic OPC, however, is very slow due to its low surface energy density (50–1000 ergs/cm$^2$), and has a very short life (less than 100 cycles) before its charge acceptance and photo-discharge capabilities deteriorate. This OPC then, is limited to slow, short-term applications like color proofing.

Also, it is known to use a positive-charging OPC made from copper phthalocyanine pigments (Pc) of a specific crystal form imbedded in a cross-linkable binder. These photoconductors have high Pc loadings, for example, in the range of about 10–30 wt. %. Also, the pigments are metal chelate phthalocyanines which are considered hazardous materials, reducing the industrial attractiveness of this OPC. Also, the specific phthalocyanine crystal form is unstable, and, after a change in the crystal form, the OPC has a low response to laser diode light sources in the 780–830 nm range, further reducing the attractiveness of this OPC for laser printer applications.

It is also known to use an improved positive-charging OPC with a thin film (less than 500 Angstroms) of diamond-like tetrahedrally bonded materials like amorphous silicon (Si), silicon carbide (SiC) and silicon nitrile (SIN) added by plasma deposition. This manufacturing method, however, is very expensive, so this OPC is not economically suitable for low end (less than 10 copies per minute) applications.

Therefore, there is a need in the liquid toner electrophotography art for a novel, single-layer positive-charging OPC with low Pc loadings, for example 1–30 wt. %, exhibiting high speed and long life. Preferably, the high speed capability is obtained by a photoconductor of low activation energy of less than 10 ergs/cm$^2$ required for discharging it in the active wave length region of infrared (IR) laser LED (600 nm–900 nm). In the prior art, this high speed capability has been obtained by certain infrared absorber pigments or dyes, including phthalocyanine compounds, dispersed in a charge transport medium as discussed above. If these pigments are of the specific crystal form which exhibits both charge generation and charge transport capability, then the OPC may be made from them simply by dispersing the IR absorbing phthalocyanine pigment in a binder matrix.

However, for these types of positive-charging OPC's, there is no data which supports their performance stability in liquid toner systems. My expectation is that the effect of liquid toners, especially those preferred by the industry which contain charge control agents, will be to contaminate the surface of the phthalocyanine pigment and binder only OPC's, resulting in positive surface charge deterioration of the OPC's, and limits on their feasibility in the high speed, high volume applications in the range above 10 copies per minute.

So, there is a need in the liquid toner electro-photography art for a novel, single-layer positive-charging OPC containing low loadings, for example, 1–30 wt. %, phthalocyanine pigment and exhibiting chemical and electrical stability. One response by the industry to this incentive has been to investigate a positive-charging, multi-layer OPC with an electron transport molecule in the upper layer which must be an electron acceptor molecule and an electron transporter molecule under the application of a positive electric field. See, for example, the disclosure of U.S. Pat. No. 4,559,287 (McAneney, et al.). These types of OPC's use derivatives of fluorenylidene methane, for example, as the electron acceptor and transport molecule. These types of molecules, however, exhibit poor solubility, resulting in recrystallization in the OPC forming mixture during coating, poor compatibility with popular binders, and poor reaction yield resulting in high production costs. Also, these types of molecules tend to be highly carcinogenic, resulting in safety risks to workers and users and therefore, low market receptivity.

Also, U.S. Pat. No. 5,087,540 (Murakami et al.) discloses a positive-charging, single-layer photo-conductor for electrophotography which has X-type and/or T-type phthalocyanine compound dispersed partly in a molecular state and partly in a particulate state in a binder resin. To make the dispersion, the phthalocyanine compound is agitated in a solvent with the binder resin for from several hours to several days. This approach, therefore, has manufacturing drawbacks.

Another response by the industry to the incentive for the development of a phthalocyanine type positive-charging OPC has been to investigate a multi-layer OPC wherein the relative positions of the charge generation and transport layers are reversed. See, for example, the disclosure of U.S. Pat. No. 4,891,288 (Fujimaki et al.). These types of OPC's, however, require a protective overcoat to avoid mechanical damage to the OPC because the upper pigment-containing layer is very vulnerable to the development component, the transfer medium component and the cleaning component in the electrophotographic system. These overcoat layers have problems of their own, increasing the residual voltage of the photoconductor and increasing its electrical instability. See, for example, the disclosures of U.S. Pat. Nos. 4,923,775 (Schank) and 5,069,993 (Robinette, et al.).

Therefore, it is an object of this invention to provide a low loading, single-layer phthalocyanine type positive-charging OPC which exhibits stable electrical properties, including charge acceptance, dark decay and photodischarge, in a high cycle, high severity, liquid toner electrophotographic process. Modern digital imaging systems wherein the writing head is LED array or laser diode, have very high light intensities (about 100 ergs/cm$^2$) over very short exposure time spans (less than 50 nano seconds), resulting in severe conditions for the OPC compared to optical input copiers with light intensities between about 10–30 ergs/cm$^2$ and exposure times between about several hundred micro-seconds to mili-seconds.

Unfortunately, there is no product on the market today which provides such stable electrical properties. This is because the phthalocyanine type positive-charging OPC exhibits instability when it is frequently exposed to the corona charger and the intense light source in the liquid toner electrophotographic process. I have discovered this instability to be more pronounced at the strong absorption, high light intensity, short exposure time conditions required for the liquid toner laser printing process. The instability is exhibited in the significant increase of the dark decay after a small number of repeat cycles of laser printing. Also, the instability is exhibited in the decrease in surface potential. These instabilities cause deleterious changes in image contrast, and raise the issue of the reliability of image quality.

Also, I have discovered that these instabilities in the phthalocyanine/binder photoconductor seem to be independent of the chemical structure or morphology of the pigment. Instead, they appear to be dependent on the nature of the contact between individual pigment particles. These observations of mine have been made only recently, and there is no report or suggestion in the prior art about how to effectively address and solve the problem of photoconductor instability.

Preferably, desirable electrophotographic performance may be defined as high charge acceptance of about 30–100 V/um$^2$, low dark decay of less than about 5 V/sec., and photodischarge of at least 70% of surface charge with the laser diode beam of 78 mn or 83 mn frequency, through the optical system including beam scanner and focus lenses, synchronized at 0.05 micro seconds for each beam.

I have discovered that this type of OPC may be obtained by a combination of special phthalocyanine pigments and sensitizers embedded in a polymeric binder. The sensitizers are chemically stable transport molecules which do not induce charge injection from the OPC surface into its center when it is frequently exposed to liquid toner, and they are compatible with the polymer binder.

SUMMARY OF THE INVENTION

My invention is a positive-charging OPC for a liquid toner system comprising fine particle phthalocyanine pigment components and an amine type sensitizer component, both distributed in a polymeric binder having polar and non-polar functional moieties. The phthalocyanine component, which is present at 0.1–30 wt. % relative to the binder, is an IR absorber. The amine sensitizer component, which is present at 0.001–90 wt. % relative to the binder, is a chemically stable charge transport compound of the arylamine type depicted in formula (I) below, or of the arylamine type depicted in formula (II) below. This charge transport compound does not induce charge injection from the surface of the OPC to its center when it is frequently exposed to liquid hydrocarbon toner. The polymeric binder has a polar functional group, like ester, carbonyl and amid groups, which stabilizes the dispersion of the phthalocyanine component. Also, the polymeric binder has a non-polar functional group, like alkane or alkene, which absorbs the hydrocarbon part of the liquid toner.

DETAILED DESCRIPTION OF THE INVENTION

An object of the present invention is to provide chemically and electrically stable components of a positive charging OPC for use in the liquid toner xerographic process. One discovered component is selected from a group of IR absorber pigments and dyes from the phthalocyanine pigment class.

Regarding the phthalocyanine pigment (Pc) component, the non-injecting, IR absorber type may be selected from many Pc pigments. I learned that many of the physical properties of the phthalocyanine pigments, such as ionization potential, seem to be more strongly dependent upon their specific morphology, rather than their chemical formula or structure. For example, after the same mechanical milling and solvent reflux purification procedure, I did not see a strong influence of the type of metal chelate on surface charge injecting level. In tests I performed, copper phthalocyanine and metal-free phthalocyanine exhibited about the same surface charge injecting level, and, surprisingly, the titanyl phthalocyanine pigment, TiOPc, exhibited a more stable positive surface charge in some cases than metal-free or hydrogen phthalocyanine $H_2Pc$. Furthermore, I discovered that specific crystal forms of certain kinds of pthalocyanine pigments seem to exhibit more stable positive surface charge. These particular pigments are x-form metal-free phthalocyanine, t-form metal-free phthalocyanine, epsilon copper phthalocyanine, and semi-crystalline titanyl phthalocyanine pigments such as acid-pasted alpha-form TiOPc, amorphous chloroindium phthalocyanine pigment, bromoindium phthalocyanine pigment, and others.

Preferably, the phthalocyanine pigment component has the general formula:

$$M-PcX_n \qquad (A)$$

Where

M=hydrogen (metal free), Cu, Mg, Zn, TiO, VO, InY (Y=halogen, Cl, Br, I, F)

X=halogen (Cl, Br, I, F), nitro —($NO_2$), cyano (—CN), sulfonyl —($RSO_2NH_2$), alkyl, alkoxy, and n=0–4.

The Pc component is not present as a chelate, but as a compound. Also, it is present in the particulate, rather than just the molecular state.

The phthalocyanine pigment component may be a single pigment selected from this group, or a combination of two or more pigments from this group.

All of these acceptable pigments exhibit extremely small particle size in the range of 50–200 nm when dispersed in chlorinated solvents. The smaller the particle size, it appears the more stable the positive surface charge on the OPC.

For this particular application, I have found the phthalocyanine pigment without metal chelate ($H_2Pc$) to be the most suitable positive charge blocking material in the xerographic process using a corona charging mechanism. Furthermore, I have found this particular material to perform well in the other charging mechanism environments, such as contact charging using polyurethane, Nylon 66 TM, etc.

The amount of phthalocyanine pigment loading in the OPC may be in the range of between 0.1 wt. % to 30 wt. %. Preferably, however, the range is 0.5 wt. % to 5 wt. %.

Another object of the present invention is to provide chemically stable charge transport molecules which do not degrade, or at least do not induce charge injection from the surface of the OPC to its center, when the material is exposed frequently to liquid toner. Another discovered component is an amine type sensitizer with these features compatible with the above-described phthalocyanine absorber pigments.

These IR absorber pigments need to be sensitized either with an amine electron donor molecule (EDM) or electron acceptor molecule (EAM), compatible with the absorber pigment and the binder material which holds and supports all of the components on the surface of the OPC. So, the whole system requires a good balance between the stable dispersion of the IR absorbers in the binder and the compatibility of the binder with the EDM or EAM sensitizer.

Generally speaking, most plastic materials may be effective as surface charge blocking materials due to their insulating properties. However, the insulating properties of the plastics usually trap the mobile charge and inhibit complete discharge of the OPC device. The above-mentioned surface charge blocking pigments may be used together with specific sensitizers selected from the group of arylamines which also exhibit low reactivity with the surface charge species which can cause the instability of the device under the wet environment of hydrocarbon fluid. The group of the specific arylamine sensitizers can be described in the general formulas I) and II), as follows:

$$N—Ar(R_i)_n,\ i=1,2,3;\ n=0,5 \quad (I)$$

where

Ar=phenyl, naphthyl, biphenyl or ter-phenyl groups, and

R=alkyl and alkoxy groups, and $$—(O—C\text{-phenyl-}N\text{-phenyl})_x \quad (II)$$

x=1–10

In my experiments I used triphenylamine as the arylamine. The amount of the sensitizer can be in a range between 0.01 wt. % to 90 wt. %. Preferably, however, range is between 1% and 70 wt. %. In my experiments, the range was about 27 wt. %.

Regarding the binder materials for this specific device, they may be chosen from a group of polymers having the ester group —OCO—, carbonyl group —CO— and amid group —CONH—, —OR group, etc. These polar functional groups are required for a stabilization of the dispersion of the IR absorber pigment on the OPC device.

These polymers are also required to have a non-polar functional group allowing the adsorption of the hydrocarbon chain of liquid toner components such as hydrocarbon fluid, but prohibiting the penetration of the hydrocarbon fluid into the cells of the OPC or binder material. These binder polymers are also required to be compatible with the amine sensitizers to ensure that the sensitizer molecule is uniformly distributed in the polymer and on the surface of the OPC device with the IR absorber pigment.

These binder polymers can be classified in the group of the polyesters, polycarbonates and polyimides; fluorinated and halogenated polymers of polyesters, polycarbonates and polyimides; and polysiloxanes such as dimethylphenyl siloxane, and copolymers thereof.

The following examples will help clarify the uniqueness of my invention.

EXAMPLE 1 (Prior Art)

25 g of x-form $H_2Pc$, 75 g of polycarbonate (Panlite) TM, and 700 g of dichloromethane were milled for 2 hrs. using glass beads as milling media. The milled suspension was filtered through a 200 mesh filter to be isolated from the beads. The suspension was then coated onto 7 mil Nickelized Estar TM using a wound wire bar and dried in an oven for 2 hours at 80° C. The thickness of the coated layer was about 10 um. The photoconductor layer was wrapped around an aluminum drum (125 mm diameter). The drum was rotated at the surface velocity of 3 inches/sec and exposed to a liquid hydrocarbon (Norpar 12, TM available from Exxon Products Co.) containing 1% solid of carbon black toner (available from Hewlett-Packard, Plotter Division). The photoconductor was charged by a positive corona charger up to 600 V and left to discharge under dark conditions for 25 sec and then exposed to a 780 nm laser diode performing 100% duty. This cycle was repeated 100 times. The surface potential before 780 nm exposure was $V_{el}$=520 V at the first cycle, and this potential was about $V_{e100}$=18 V after the 100th cycle. This means $V_{e100}/V_{el}$=about 4%.

EXAMPLE 2 (Invention)

3 g of x-H2Pc, 27 g of triphenylamine, 70 g of polycarbonate (Panlite) TM and 700 g of dichloromethane were mixed together using the same milling procedure described in Example 1 above. The stability test cycle of Example 1 was repeated. The ratio of $V_{e100}/V_{el}$=about 98%, was measured, indicating an excellent stability of the surface charge under the wet condition with liquid toner. The xero-graphic speed of this photoconductor for positive charging with 780 nm laser diode exposure was detected to be about 6 ergs.

While there is shown and described the present preferred embodiment of the invention, it is to be distinctly understood that this invention is not limited thereto but may be variously embodied to practice within the scope of the following claims,

What is claimed is:

1. An electrophotographic method comprising:

(a) establishing a uniform positive charge on a positive-charging, organic photoconductor, then;

(b) exposing said positive-charging, organic photoconductor to light, said photoconductor comprising:

a conductive substrate;

a polymeric binder component having both polar and non-polar functional moieties, said binder component forming a layer greater than or equal to about 1 micron thick on said substrate;

a metal-free phthalocyanine component, present at 0.1–39 wt. % relative to said binder component, said phthalocyanine component being uniformly distributed throughout said binder component to make a single photoconductor layer on said conductive substrate; and, an arylamine sensitizer component, present at 0.001–90 wt. % relative to said binder component, selected from the group of:

$$N—Ar(R_i)_n,\ i=1,2,3;\ n=0,5$$

where

Ar=phenyl, naphthyl, biphenyl or ter-phenyl groups, and

R=alkyl and alkoxy groups, and

—(O—C-phenyl-N-phenyl)$_x$, x=1-10, said arylamine sensitizer component also being uniformly distributed throughout said binder component in said single photoconductor layer on said conductive substrate, to form a latent image on said photoconductor; and, (c) developing said latent image with a liquid toner containing pigment components.

2. The method of claim 1 wherein the photoconductor phthalocyanine component has the general formula:

$$M-PcX_n \quad (A)$$

where

M=hydrogen (metal free)

X=halogen (Cl, Br, I, F), nitro —$NO_2$), cyano (—CN), sulfonyl —$RSO_2NH_2$), alkyl, alkoxy, and n=0-4.

3. The method of claim 2 wherein the photoconductor phthalocyanine component is a combination of two or more pigments from the group.

4. The method of claim 1 wherein the photoconductor phthalocyanine component is present in the range of 0.5 to 5 wt. %, relative to the binder.

5. The method of claim 1 wherein the photoconductor arylamine sensitizer component is present in the range of 1-70 wt. % relative to the binder.

6. The method of claim 5 wherein the photoconductor arylamine sensitizer component is present in the range of about 27 wt. %.

7. The method of claim 1 wherein the photoconductor binder component is polycarbonate.

8. An electrophotographic method comprising:

(a) establishing a uniform positive charge on a positive-charging organic photoconductor, then;

(b) exposing said positive-charging, organic photoconductor to light, said photoconductor comprising:

a conductive substrate;

a polymeric binder component having both polar and non-polar function moieties, said binder component forming a layer greater than or equal to about 1 micron thick on said substrate;

a metal-free phthalocyanine component, present at 0.1-30 wt. % relative to said binder component, said phthalocyanine component being uniformly distributed throughout said binder component to make a single photoconductor layer on said conductive substrate; and, an arylamine sensitizer component, present at 0.001-90 wt. % relative to binder component, selected from the group of:

N—Ar($R_i$)$_n$, i=1,2,3; n=0,5 where Ar=phenyl, naphthyl, biphenyl or ter-phenyl groups, and

R=alkyl and alkoxy groups, and

—(O—C-phenyl-N-phenyl)$_x$, x=1-10, said arylamine sensitizer component also being uniformly distributed throughout said binder component in said single photoconductor layer on said conductive substrate, to form a latent image on said photoconductor;

(c) developing said latent image with a liquid toner containing pigment components; and, (d) repeating steps a-c above more than 100 times wherein the positive charge on said photoconductor after step a above is greater than about 98% of the first positive charge established on said photoconductor.

* * * * *